United States Patent [19]

Lindley

[11] Patent Number: 4,461,047

[45] Date of Patent: Jul. 24, 1984

[54] LEDGE BED OVERLAY

[76] Inventor: William L. Lindley, P.O. Box 1292, Conroe, Tex. 77301

[21] Appl. No.: 391,126

[22] Filed: Jun. 23, 1982

[51] Int. Cl.[3] ..... A61G 7/02

[52] U.S. Cl. ..... 5/90; 5/63; 5/508

[58] Field of Search ..... 5/63–65, 5/71, 72, 77, 90, 431, 508, 509

[56] References Cited

U.S. PATENT DOCUMENTS

| | | | |
|---|---|---|---|
| 794,978 | 7/1905 | Hall | 5/90 |
| 933,323 | 9/1909 | Mitchell . | |
| 1,274,851 | 8/1918 | Byrd | 5/65 |
| 1,815,742 | 7/1931 | Schiffhouer . | |
| 1,866,397 | 7/1932 | Clewley | 5/431 |
| 2,285,474 | 6/1942 | Urie | 5/90 |
| 2,373,017 | 4/1945 | Deckert | 5/90 |
| 2,445,158 | 7/1948 | Sparhawk | 5/60 |
| 2,834,401 | 5/1958 | Tanner | 5/90 |
| 3,224,016 | 12/1965 | Anderson | 5/90 |
| 3,343,181 | 9/1967 | Grant | 5/90 |
| 3,465,367 | 9/1969 | Emery | 5/71 |
| 3,991,428 | 11/1976 | Hanson | 5/90 |
| 4,136,409 | 1/1979 | Ishida | 5/90 |
| 4,139,917 | 2/1979 | Fenwick | 5/66 |
| 4,183,109 | 1/1980 | Howell | 5/60 |

*Primary Examiner*—Alexander Grosz
*Assistant Examiner*—Michael F. Trettel
*Attorney, Agent, or Firm*—Pravel, Gambrell, Hewitt, Kirk & Kimball

[57] ABSTRACT

A ledge bed overlay for use with conventional patient care beds whereby a ledge can be formed to facilitate placing a bedpan or a bathtub beneath a patient without having to physically lift the patient.

9 Claims, 4 Drawing Figures

LEDGE BED OVERLAY

FIELD OF THE INVENTION

The ledge bed overlay of the present invention is intended for cooperative use with conventional patient care beds in hospitals, nursing homes and the like where it is desirable to position a bedpan or bathtub beneath a patient lying on such bed without a hospital attendant having to physically lift the patient. The ledge bed overlay of the present invention is adapted to be mounted with conventional patient care bed frames and form a ledge to facilitate patient care.

PRIOR ART

Generally, conventional patient care beds provide a mattress support having an upper torso and lower torso support sections pivotally and adjustably connected to a rigid main frame. Such conventional patient care beds provide for inclination of both the upper torso and the lower torso support. As far as is known by the applicant, such inclination is obtained by inclining the upper torso and lower torso support sections which are pivotally connected to the bed's main frame. Inclination of either the upper torso or lower torso support section provides no configuration of the bed mattress whereby a ledge is formed and a hospital attendant may easily position a bedpan or bathtub beneath a patient without physically lifting the patient.

The applicant's copending application Ser. No. 352,348 describes a ledge bed frame including a mattress support which may be positioned to form a ledge bed whereby a bedpan or bathtub can easily be placed beneath a patient without physically lifting the patient. The present invention is directed towards a ledge bed overlay, whereby conventional patient care beds can be easily and economically modified to form a ledge bed.

Generally, prior art patient beds such as shown in U.S. Pat. Nos. 933,323; 1,815,742; 2,445,158; 4,136,409; 4,139,917; and 4,183,109 have all provided means for variably adjusting mattress support sections of a patient care bed. Only U.S. Pat. Nos. 933,323 and 4,139,917 were capable of also being positioned such that a bedpan might be placed beneath the patient, but obtain such result with different structure and operation. Moverover, the applicant is aware of no such apparatus or device which can be adapted to conventional patient care beds wherein a ledge can be formed to easily place a bedpan or bathtub beneath the patient without physically lifting the patient.

SUMMARY

A ledge bed overlay apparatus for use in cooperation with conventional patient care beds to position a bedpan or bathtub beneath a patient without a hospital attendant having to physically lift or move the patient on the patient care bed so modified. The ledge bed overlay apparatus includes a support member pivotally mounted with the upper torso support section of a conventional patient care bed. The ledge bed overlay further includes a stiff leg assembly pivotally connected to the support member whereby when the stiff leg assembly is positioned vertically to the ground surface and the conventional patient care bed is lowered, a ledge is formed whereby a bedpan or bathtub can easily be placed beneath the patient without the hospital attendant having to physically lift the patient.

The support member is preferably a flat sheet or pan which includes a pair of rotation pins suitably attached thereto. The stiff leg assembly pivotally engages and accepts such rotation pins so that the stiff leg assembly may be rotated about the rotation pins. When the support member is attached to the upper torso support section of a conventional patient care bed and the stiff leg assembly rotatably attached thereto is vertically positioned to engage the floor surface and the main frame is lowered, the support member is displaced vertically from the main frame and the lower torso section of the conventional patient care bed to form a ledge.

The ledge bed overlay apparatus of the present invention is designed to be compatible with the operating features of conventional patient care beds. As such, conventional patient care beds can be easily and economically modified to accept the ledge bed concept. The ledge bed overlay obviates the need for multiple hospital attendants, as is often the case, to assist in routine patient care practices as well as lessens the cooperative effort required of the patient.

DESCRIPTION OF THE PREFERRED EMBODIMENT

Figure 1:
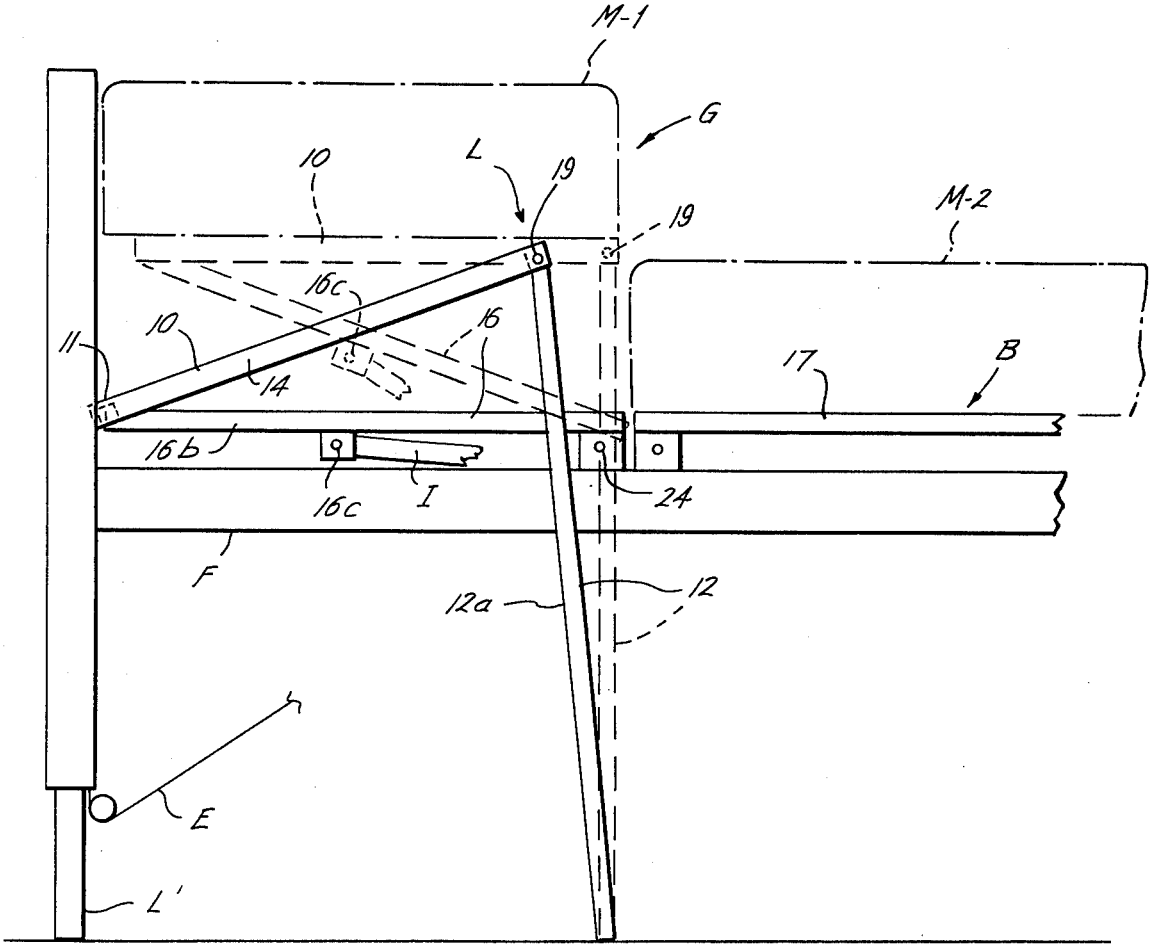
FIG. 1 is a side view of the ledge bed overlay attached to a conventional patient care bed showing two positions of the ledge bed overlay whereby a ledge is formed.
Figure 2:
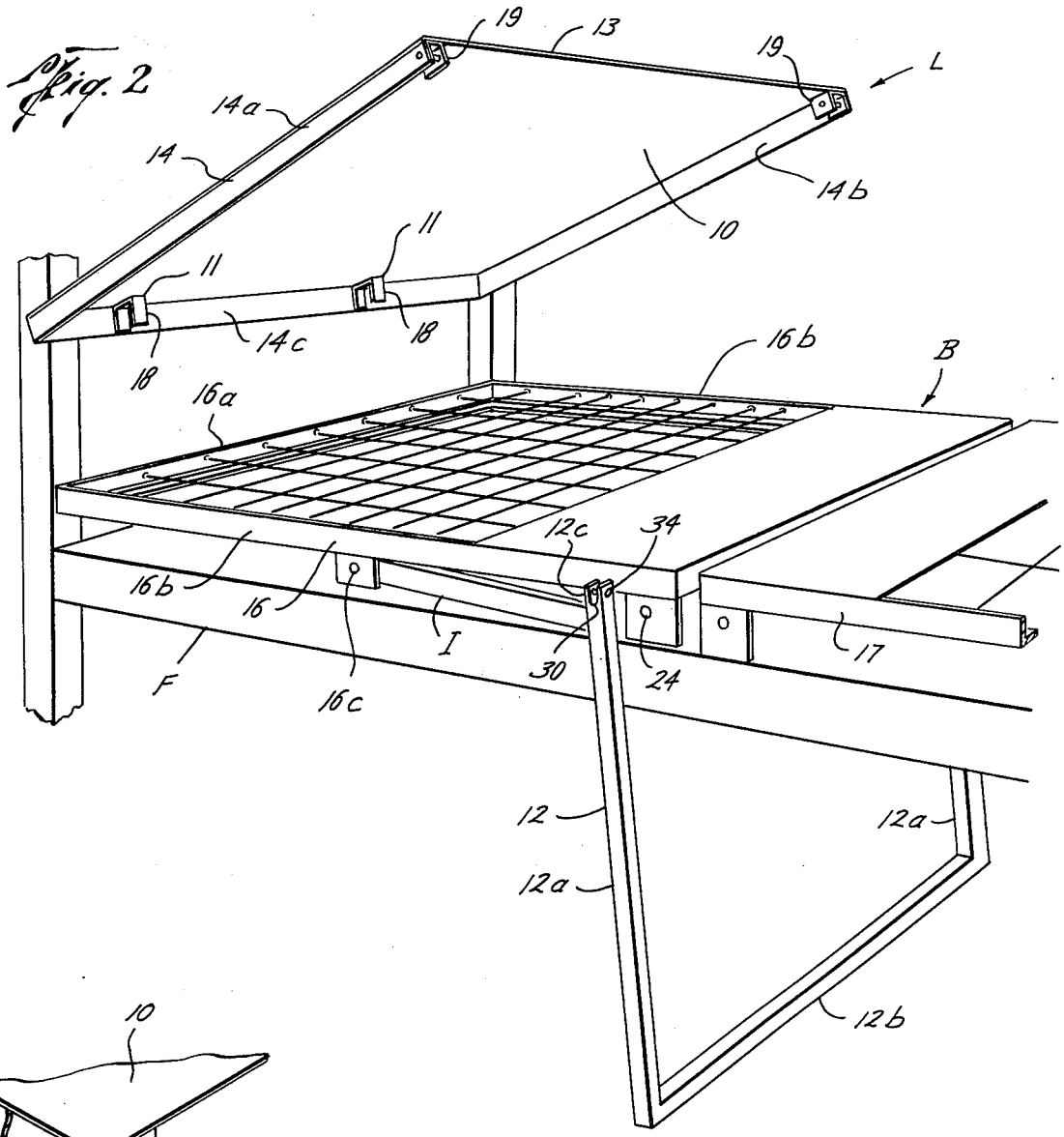
FIG. 2 is a perspective, partially exploded view of the ledge bed overlay and the conventional patient care bed.
Figure 3:
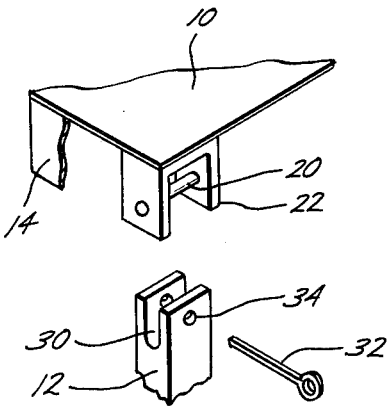
FIG. 3 is a detailed exploded section drawing showing the means for pivotal engagement of the support member to the stiff leg assembly of the present invention.
Figure 4:
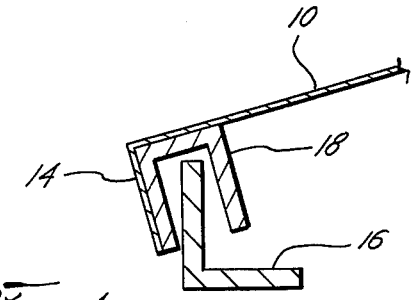
FIG. 4 is a detailed cross-sectional drawing showing the pivotal engagement of the support member of the present invention with a support rail of the conventional patient care bed.

The ledge bed overlay of the present invention is generally designated L in the drawings. As best seen in FIGS. 1 and 2, the ledge bed overlay L includes a mattress support member 10 having coupling means 11 attached at one end thereof. Coupling means 11 pivotally engage a conventional patient care bed B.

The ledge bed overlay L further includes a stiff leg assembly 12 pivotally connected to an opposite end of the support member 10. When stiff leg assembly 12 is positioned vertically and the conventional patient care bed B is lowered on its frame in a conventional manner, the stiff leg assembly 12 engages the floor surface and the support member 10 is displaced vertically from the bed B to form a ledge G.

Support member 10, is a substantially planar sheet 13, preferably of 16 gauge sheet metal or the like. A lip 14 extends about a substantial portion of the perimeter of the planar sheet 13 and is attached thereto. Support member 10 is coextensive with an upper torso mattress support section 16 of the conventional patient care bed B. Lip 14 retains the alignment of the support member 10 upon the upper torso support 16. Lip 14 includes side members **14*a* and 14*b* as well as a head member 14*c***.

The support member 10 further comprises coupling means 11 to pivotally engage the upper torso mattress support 16 of the conventional patient care bed B. Coupling means 11 includes yokes 18 attached to the underside of the support member 10 a spaced distance apart and adjacent to head member 14c. Yokes 18 have a slotted opening adapted to engage a support rail 16a of the upper torso mattress support 16.

The support member 10 includes pivotal means 19 mounted on the underside of sheet 13 to pivotally engage the stiff leg assembly 12. The pivotal means 19 includes a pair of brackets 20 attached to the under side of support member 10 adjacent side members 14a, 14b at the lower end of support member 10. The brackets 20 have rotation pins 22 mounted therein to rotatably engage the stiff leg apparatus 12 as further described.

When support member 10 is mounted with the upper torso mattress support 16, pivotal means 19 are preferably exterior to siderails 16b of upper torso mattress support 16 and bed frame F. As such, stiff leg assembly 12 can be freely rotated between an operative, substantial vertical position and a stored, retracted position when bed frame F is elevated to a height sufficient for the stiff leg assembly 12 to disengage the ground surface.

Stiff leg assembly 12 comprises a pair of parallel ground engaging legs 12a interconnected with leg brace 12b to enhance the rigidity of the stiff leg assembly 12. Stiff leg assembly 12 is preferably a U-shaped assembly formed from a single piece of pipe, channel iron or the like.

The upper ends 12c of each parallel leg 12a have slots 30 to pivotally engage rotation pins 22 mounted on the support member 10. Each parallel leg 12a at its upper end 12c further includes a fastener hole 34 transverse to the longitudinal axis of the slot 30. The fastener hole 34 is located a predetermined distance above the bottom of slot 30 such that when rotation pin 22 is positioned in slot 30, a securing means 32 may pass through the fastener hole 34 and over rotation pin 22 to retain the stiff leg assembly 12 in pivotal engagement with support member 10.

The stiff leg assembly 12 is a predetermined length short of engaging the ground surface when the conventional patient care bed B is raised to its highest elevation to permit the stiff leg assembly 12 to be rotated to a retracted or stored position which is pivoted underneath the bed frame so that leg brace 12b is disposed towards the head portion of the frame F as compared to its operative, substantially vertical position shwon in FIG. 1.

A typical patient care bed B generally includes a rigid main frame F having elevation means E with the main frame to cause the main frame F to raise and lower upon telescopically connected support legs L' (a portion of which is illustrated). Such patient care bed B further includes an upper torso mattress support section 16 and a lower torso mattress support section 17 mounted with the main frame for pivotal movements relative thereto, as will be well understood. Any well known means for inclination I (a portion of which is shown) is connected to the upper torso mattress support 16 at pivot point 16c for pivoting same about pivot pins 24 to adjustably incline the upper torso support mounted with the frame F in the conventional well known arrangement. In the preferred embodiment, a split mattress having an upper torso mattress M-1 and a lower torso mattress M-2 is used, although it could be a unitary mattress. See, for example, a more complete description of a typical conventional patient care bed structure B in applicant's copending application Ser. No. 352,348.

With the ledge bed overlay apparatus L of the present invention attached to a conventional patient care bed B, a ledge G may be formed whereby a bathtub or bedpan may be placed beneath a patient without physically lifting the patient, thereby greatly facilitating patient care. To form ledge G, stiff leg assembly 12 is moved from its retracted or stored, angled position to a substantially vertical, operative position by first raising the bedframe F to a high enough position to allow the stiff leg assembly 12 to hang in a substantially vertical position such as shown in FIG. 1. Then, the bed frame F is lowered until stiff leg assembly 12 engages the ground surface. Continued lowering of the bed frame F also lowers the attached upper torso mattress support 16 while pivotally attached stiff leg assembly 12 displaces the lower end of support member 10 such that it retains substantially the same vertical position with respect to the ground surface.

The upper end of support member 10 having pivotally engaged the support rail 16a of the upper torso mattress support 16 is concurrently lowered with the lowering of the bed frame F. As such, support member 10 is disposed at an inclined attitude with respect to the bed frame F as shown in FIG. 1 and the ledge G is thereby formed.

After the ledge G has thus been formed, the inclination means I of the conventional patient care bed B is preferably operated to pivot the upper torso's mattress support 16 about rotation pins 24 of the conventional patient care bed to position support member 10 substantially horizontal as shown in phantom in FIG. 1. Inclination of upper torso support 16 rotates support member 10 about pivot means 19 while legs 12a remain essentially in the same position, thereby raising the upper part of the mattress M-1 (left end as viewed in FIG. 1) to elevate the patient's head, if desired. Continued operation of inclination means I further elevates the patient's head. Ledge G formed by the vertical displacement of support member 16 is retained during the above described inclination of the upper torso support section 16.

Since stiff leg assembly 12 pivotally engages support member 10 exterior to upper torso support 16 and bed frame F, raising or lowering of the bed frame F does not interfere with the pivotal cooperation of the stiff leg assembly 12 and support member 10. The upper end of support member 10 maintains its pivotal engagement with upper torso support 16 during the inclination of the upper torso mattress support 16 becuse of the cooperation between support rail 16a and coupling means 11.

Since the support member 10 is coextensive with the upper torso mattress support 16, mattress M-1 and M-2 are essentially coplanar while the ledge bed overlay apparatus is in the stored or retracted position.

Method of Assembly

Support member 10 is pivotally attached to the upper torso mattress support 16 whereby the coupling means 11 pivotally engage the upper end of upper torso mattress support 16. Coupling means 11 includes yokes 18 which rotatably engage support rail 16a of upper torso mattress support 16.

Stiff leg assembly 12 is positioned beneath the main frame F of the patient care bed B. The stiff leg assembly 12 is then brought into pivotal engagement with the support member 10. The upper ends 12c of stiff leg assembly 12, having slots 30 adapted to receive rotation pins 22, are brought into pivotal engagement with rotation pins 22. The rotation pins 22 are mounted with brackets 20 attached to the underside of sheet 13. The stiff leg assembly 12 engages rotation pins 22 exterior to siderails **16*b* and bed frame F. The securing means 32, preferably a cotter pin, nut and bolt or the like, is passed through the transverse retaining hole 34 of stiff leg assembly 12 to retain the stiff leg assembly 12 in rotatable engagement with the support member 10**.

The ledge bed overlay apparatus L of the present invention is intended for cooperative use with conventional patient care beds in hospitals, nursing homes and the like where it is desirable to position a bedpan or bathtub beneath a patient lying on such bed without a hospital attendant having to physically lift the patient. Moreover, the ledge bed overlay apparatus L is adapted to easily and economically modify conventional patient care beds for form a ledge and facilitate patient care.

The foregoing disclosure and description of the invention are illustrative and explanatory thereof, and various changes in size, shape and materials as well as in the details of the illustrated construction may be made without departing from the spirit of the invention.

I claim:

1. A ledge bed overlay apparatus adapted to be positioned with a conventional patient care bed having a vertically moveable bed frame, an upper torso mattress support section which is pivotally mounted on the bed frame for movement from a horizontal position to an inclined position to elevate the head of a patient relative to the rest of the patient's body, said overlay apparatus including:

a mattress support member;

means with said mattress support member for pivotally mounting an upper end of said mattress support member with the upper torso mattress support section of the patient care bed;

a stiff leg assembly for pivotal attachment to said mattress support member; and, pivot means mounted with the lower end of said mattress support member pivotally engaging said stiff leg assembly to a lower end of said mattress support member for swinging from a retracted position to an operative substantially vertical position with its lower end engaged with the floor, whereby lowering of the bed frame with said stiff leg assembly in the operative position creates a ledge for supporting the upper torso portion of the patient's body at an elevation above said horizontal position of the upper torso mattress support section.

2. The ledge bed overlay apparatus of claim 1, further including:

securing means mounted with said stiff leg assembly for securing and retaining said stiff leg apparatus in pivotal engagement with said mattress support member.

3. The ledge bed overlay apparatus of claim 1, wherein said pivotal engagement of said stiff leg assembly and said mattress support member includes:

said stiff leg assembly is pivotally attached with said mattress support member exterior to the bed frame and the upper torso mattress support.

4. The ledge bed overlay apparatus of claim 1, wherein said mattress support member includes:

a substantially planar sheet;

said substantially planar sheet being coextensive with the upper torso mattress suport; and a lip extending about a substantial portion of the perimeter of said substantially planar sheet and is attached thereto whereby the alignment of said support member and the upper torso mattress support is retained.

5. The ledge bed overlay apparatus of claim 1, wherein said means for pivotally mounting said mattress support member with the upper torso mattress support section includes:

said means pivotally mounting said mattress support member with the upper torso mattress support section for cooperating with the upper torso mattress support section to retain the pivotal engagement as the upper torso mattress support section is moved to an inclined position to elevate the head of the patient.

6. A ledge bed overlay apparatus, comprising:

a support member;

said support member includes:

a substantially planar sheet;

a lip extending about a substantial portion of the perimeter of said substantially planar sheet and attached thereto; and a pair of yokes attached to the underside of said support member at its upper end a spaced distance apart;

a stiff leg assembly for pivotal attachment to said support member; and pivot means mounted with said support member for pivotally connecting said stiff leg assembly to the lower end of said support member.

7. The ledge bed overlay apparatus of claim 6, further including:

retaining means for securing and retaining the pivotal engagement of said stiff leg assembly and said support member.

8. The ledge bed overlay apparatus of claim 6, wherein said pivot means includes:

brackets attached to the underside of said support member; and, rotation pins mounted with said brackets to rotatably engage said stiff leg assembly.

9. The ledge bed overlay apparatus of claim 1 or 6, wherein said stiff leg assembly includes:

a pair of parallel ground engaging legs; and a brace interconnected between said parallel legs to enhance the rigidity of said stiff leg assembly.

* * * * *